United States Patent [19]

Markewitz et al.

[11] Patent Number: 4,467,993

[45] Date of Patent: Aug. 28, 1984

[54] FORM SYSTEM FOR CEILING FORMWORKS

[75] Inventors: Wolfgang Markewitz, Hilden; Heinz Schwechheimer, Jüchen, both of Fed. Rep. of Germany

[73] Assignee: Hunnebeck GmbH, Fed. Rep. of Germany

[21] Appl. No.: 322,977

[22] Filed: Nov. 19, 1981

[30] Foreign Application Priority Data

Dec. 9, 1980 [DE] Fed. Rep. of Germany ..... 3046284

[51] Int. Cl.[3] ..... E04G 11/36

[52] U.S. Cl. ..... 249/28; 249/137; 249/139; 249/161; 249/170; 249/192

[58] Field of Search ..... 249/26, 28, 192, 195, 249/193, 211, 29, 137, 139, 161, 170, 185

[56] References Cited

U.S. PATENT DOCUMENTS

| | | | |
|---|---|---|---|
| 1,429,412 | 9/1922 | Davidson | 249/193 |
| 2,866,252 | 12/1958 | Cobi | 249/211 |
| 3,052,008 | 9/1962 | Bowden | 249/192 |
| 3,130,470 | 4/1964 | Bowden | 249/192 |
| 3,430,910 | 3/1969 | Bowden | 249/192 |
| 3,630,479 | 12/1971 | Sullivan | 249/28 |
| 3,689,020 | 9/1972 | Martin | 249/195 |
| 3,917,214 | 11/1975 | Ratcliff | 249/211 |
| 4,192,623 | 3/1980 | Borg | 249/211 |

*Primary Examiner*—John Parrish

*Attorney, Agent, or Firm*—Thomas J. Greer, Jr.

[57] ABSTRACT

An unsupported form system for ceiling formworks is disclosed which comprises of three elements, i.e. extensible shores, head elements on the top of said shores and form boards to be positioned directly on the head elements. The head elements have flat supports for the boards which, for their part, have an open frame, the edges thereof cooperating with truncated pyramid noses on said supports. The boards may be suspended on the head elements of erected shores from below and may be brought into their horizontal operational position with the next shores once these have been erected. Pivotal levers are used for supporting adjacent boards between those which are supported directly on the head elements which interconnect said shores in pairs.

9 Claims, 8 Drawing Figures

FORM SYSTEM FOR CEILING FORMWORKS

BACKGROUND OF THE INVENTION

This invention relates to a form system for ceiling formworks which comprises shores and form boards which are supported by these shores thus that their edges contact one abother to form a continuous uninterrupted forming surface.

At present, formworks for ceilings are erected such that form bearing members which may be pre-fabricated, or crossbeam timbers which are cut to size on site, are positioned on steel tube supports or shores which have been adjusted to a specific length. Depending on the load to be expected of the concrete forming the ceiling, other cross-girders or pieces of wood are positioned transversely, and the form boards or plates are positioned thereon. In the known form systems, pre-fabricated form boards are positioned between form bearers which are also prefabricated and are positioned on the steel tube supports, so that the form boards and the form bearers provide a continuous forming surface.

A disadvantage of these known ceiling formwork systems is the fact that they must be adapted as regards their structure and the material of which they are made to the respective strains, i.e. where there are changes in the constructional dimensions, such as in the ceiling thickness or in the height of the room, the dimensions of the cross-girders and the form boards vary, caused by the necessary changes in the mutual spacings of the steel tube supports. This in turn, necessitates keeping a correspondingly large stock which has a considerable effect on the investment cost involved. The comprehensive stock needed leads to an uneconomic stock utilization factor. Furthermore, keeping a stock which is appropriate to all cases of use necessitates a large number of individual parts.

As ceilings are positioned above the floor or ground at a height which is greater than the human reach, various people are required for erecting these known ceiling formworks, namely workmen to position the shores, workmen to move the form bearing members from auxiliary platforms and/or ladders, and workmen to work on the form surface in order to position the form boards from above into the form bearing members.

Thus, high assembly costs and extra costs, which cannot be calculated in advance, for auxiliary frames and for the erection thereof are added to the high investment costs.

BRIEF SUMMARY OF THE INVENTION

The present invention is based on the object of providing a form system for concrete ceilings which substantially avoids the previously-mentioned disadvantages of a bearing member/board form and which permits stock-keeping such that a practically 100% utilization factor is achieved, using a few individual parts, i.e. involving low investment costs.

According to the present invention there is provided a form system for ceiling formworks, comprising of three elements, i.e. shores or the like, head pieces in form of cross-beams and form boards to be positioned on the head pieces which are to be positioned on the shores, interconnecting the shores in pairs. For erecting ceiling formworks it is not necessary to use bearing members for transferring the load into the shores. Instead, the invention provides an unsupported form system which requires form boards of only one size.

The present invention uses a method in which base panels and intermediate panels are mounted or dismounted alternately during the mounting or dismounting of the form work. This has the great advantage that the support for the base panels may be constructed in the manner of a frame and can be provided with scaffold platforms for operation, while the boards of the intermediate panels are subsequently installed and are supported on pivotal levers provided at the base panels.

In order to eliminate the risk of accidents associated with moving the form boards from a badly secured ceiling form work surface, the complete system is installed from below, so that nobody has to work on the form surface during assembly. This is made possible with a so-called head frame part or head part which is attached onto the shores and on which the unsupported ceiling formwork boards directly lie without the necessity to use additional form girders or the like. Thus, the complete system only consists of three individual parts having fixed dimensions. Frame-like scaffolds are built up from usual extensible steel tube supports or shores, and cross beams interconnecting the shores in pairs. As a result of this, the stock-keeping and control are simple, and the investment and assembly costs are reduced and may be calculated in advance with a practically 100% utilization factor.

DETAILED DESCRIPTION OF PREFERRED EMBODIMENTS

Figure 1:
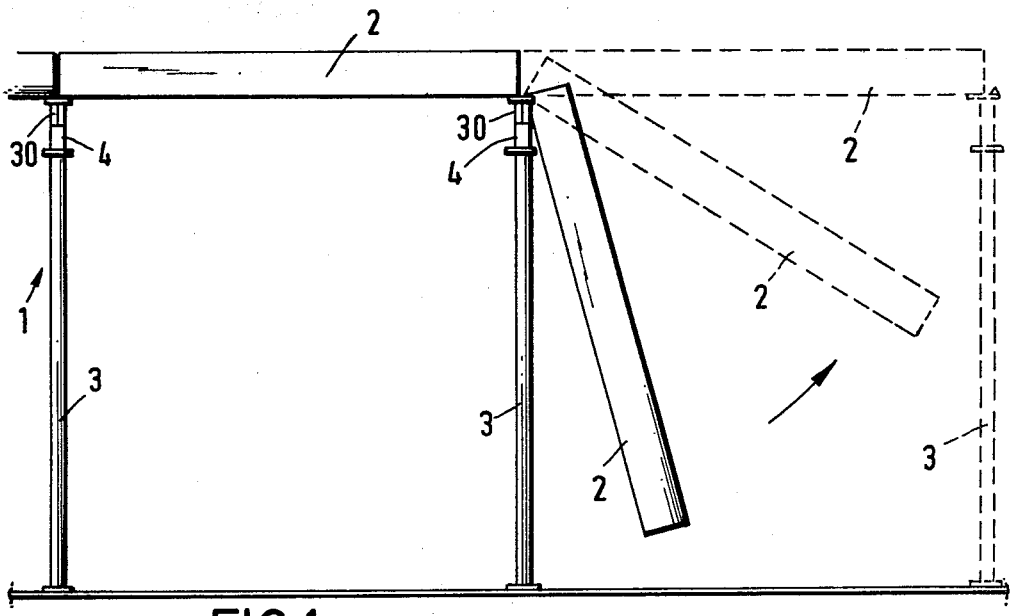
FIG. 1 illustrates a side view of a ceiling formwork which is constructed from elements of the form system according to the present invention.

As mentioned above, in the present invention the cross-beams arranged on the shores of the form system have flat supports or bearing surfaces for the form boards and the form boards have a frame which cooperates with projections on the flat supports. In this form system, the projections of the supports or bearing surfaces of the cross-beams accommodate the lower edges of the form board frames which co-operate with the projections thus that during asembly each form board may first be suspended with one edge to the supports of the adjacent cross-beam, whereupon the opposite end of this form board is swung up into the required horizontal operating position and is positioned on the next cross-beam so that it is in the required operating position. All these manoeuvres may be carried out from below, so that it is unnecessary to have additional workmen for positioning form boards from above onto the shores which have already been erected. Depending on the size and weight of the form boards, they may be handled by one or more people. The lower edges of the frame of the boards form a sort of socket link in conjunction with the supports or bearing surfaces of the cross-beams which link ensures that the boards are pivotal with respect to the supports.

According to a preferred practical embodiment of the present invention, the shores are interconnected in pairs at their upper ends via a head piece thus that they are positioned at a spacing from each other which is slightly smaller than the width of a form board. On the thus supported head pieces the form boards of a base panel are arranged.

In order to position neighbouring form boards of the intermediate panels, according to another feature of the present invention, a short bracket is positioned on each side of the head peice which is outwardly pivotal and provides a type of rapidly-lowerable bearing or support for a neighbouring row of form boards of intermediate panels. In this arrangement, each bracket has on its outer end a flat support with upwardly extending projections in order to be able to install the neighbouring rows of from boards of the intermediate panels in the above-described manner.

The brackets supporting the form boards of the intermediate panels may be designed as levers which may be pivoted about a horizontal axis, so that the movements required for adjustment take place vertically. The pivoting movements of the levers may be produced using a simple tool, such as, for example, a rod, so that the worker does not have to reach up to the individual levers. Instead, an operation from the normal floor is easily possible, even where there are ceilings of a greater height. By using a tool, such as a rod, it is possible to pivot the individual levers into their operating positions as well as to release the catch associated with each lever when a lever is to be pivoted back out of the operating position, for example when dismantling the form.

With an arrangement of this type, a ceiling formwork may be erected in two rows which always alternate with each other, one row of form boards being directly supported by the shores and by the head pieces interconnecting them, whereas the next row which is immediately adjacent in each case is supported by the pivoted-out brackets. Once the ceiling has been cast and has at least set temporarily, the form boards resting on the brackets may be removed by swinging back the brackets, so that the relevant form boards are free for dismantling. If the ceiling still requires a support, the form boards positioned directly above the shores may remain. Thus, some of the form boards which were used are available again relatively quickly, while the ceiling which has not yet completely set is still supported over a large area, namely over individual rows of form boards (base panels), until they may be removed from here as well. The amount of work and time which is required for the removal of some of the boards is significantly lower, measured against the previous practice of initially dismantling the form and then positioning auxiliary supports.

The form system according to the present invention only comprises of shores, head pieces and form boards and is thus absolutely unsupported, in contrast to all the hitherto known formwork systems for ceilings.

Referring now to the drawings, the ceiling formwork 1 is composed of individual form boards 2 and of shores 3 carrying the boards, as illustrated in FIG. 1.

Individual shores 3 are initially erected and then on each pair of adjacent shores 3 a board 2 is suspended at one end, whereupon the free end of this board 2 which is hanging down is swung up and positioned onto the next pair of shores 3 to be erected, as illustrated in dashed lines in FIG. 1. In this manner, the ceiling formwork 1 may be gradually built up from below, with only a small number of workers being involved.

The shores 3 are conventional extensible steel tube supports which are interconnected in pairs via a cross-beam 4 positioned thereon, said cross-beams being used as upports for the form borads 2, as explained in more detail below. Pairs of shores 3 each held together by a cross-beam 4 are positioned in tandem or one after the other in FIG. 1, so that only the front shore 3 of each pair can be seen.

Figure 2:
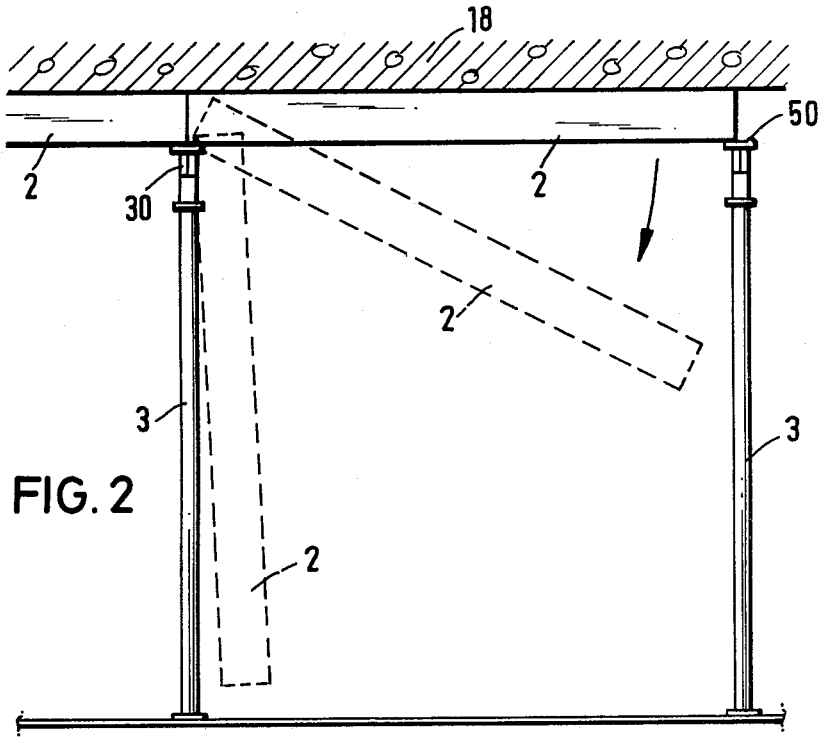
FIG. 2 illustrates a partial view of the ceiling formwork as in FIG. 1, showing the dismantling of a form board.

FIG. 2 illustrates the operation of dismantling the form, after the completion of a concrete ceiling 18. To successively dismantle the individual form boards 2, levers 30 provided at the cross beams 4 of one pair of shores 3 supporting said board 2 are first of all swung back so that the end of said board 2 which is now released may swing downwards until it is suspended in a substantially vertical direction. It may now be disconnected from the next levers 30. The boards 2 which are directly supported by the pairs of shores 3 are dismantled in the same manner, by first of all removing the pair of supporting shores 3 at one end of the relevant board 2, and allowing this board to swing downwards. In both cases, the thus suspending board can be removed by hand.

The form is erected in the same manner, but in reversed sequence.

Figure 3:
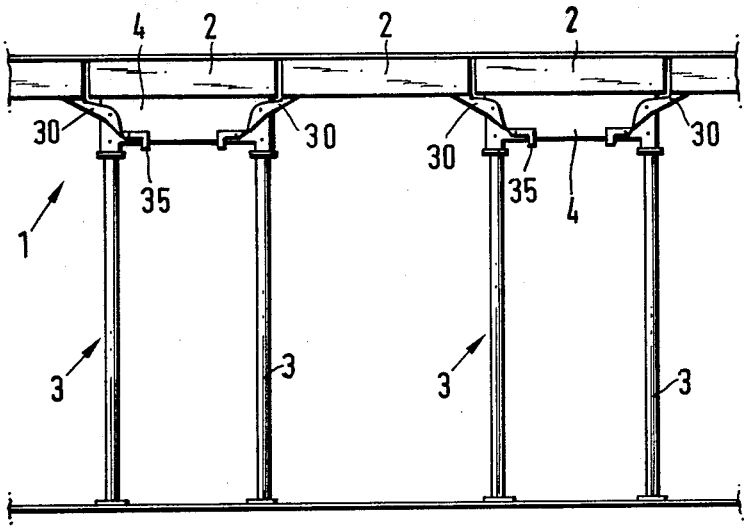
FIG. 3 illustrates a front view of the ceiling formwork, in which the form boards which are positioned between the boards resting on the interconnected steel tube supports are supported on levers which may each be pivoted about a horizontal axis.
Figure 8:
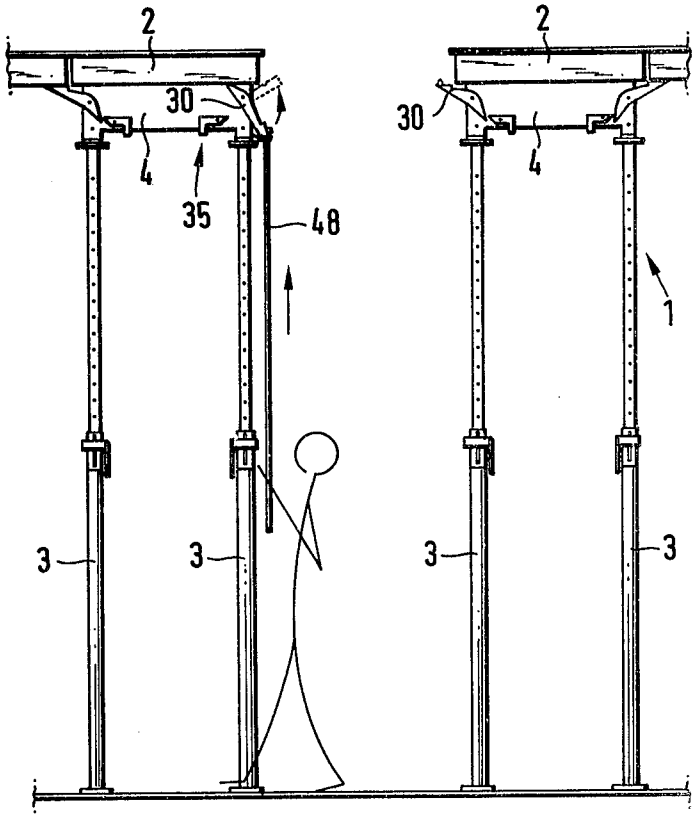
FIG. 8 schematically illustrates the ceiling formwork from FIG. 3, in which it may be seen how a double-armed lever is swung into its operating position in order to position a form board.
Figure 7:
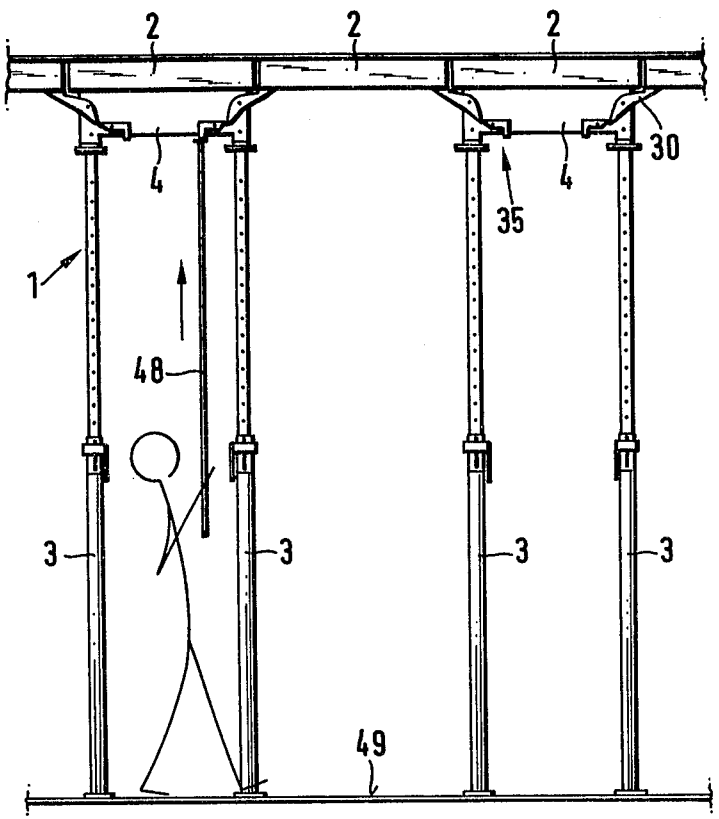
FIG. 7 schematically illustrates the ceiling formwork from FIG. 3 at the start of the dismantling of the form.

It may be seen from FIGS. 3, 7 and 8, that in each case, only every second row of boards 2 is directly supported on the cross-beams 4. In this embodiment, the intervening rows of boards 2 rest on double-armed levers 30 which project out at the side over the cross-beams 4 in the operating position, and each of these double-armed levers has on the outer end of the one heavier lever arm 31 a flat support 32 for a board 2 and a projecting nose 33 in form of a truncated pyramid, whereas the other lever arm 34 having a lower weight than the first lever arm co-operates with a spring-adjustable catch 35. Each lever 30 may be pivoted about a horizontal shaft 36 which is secured on a bush 37 of the cross-beam 4.

Figure 6:
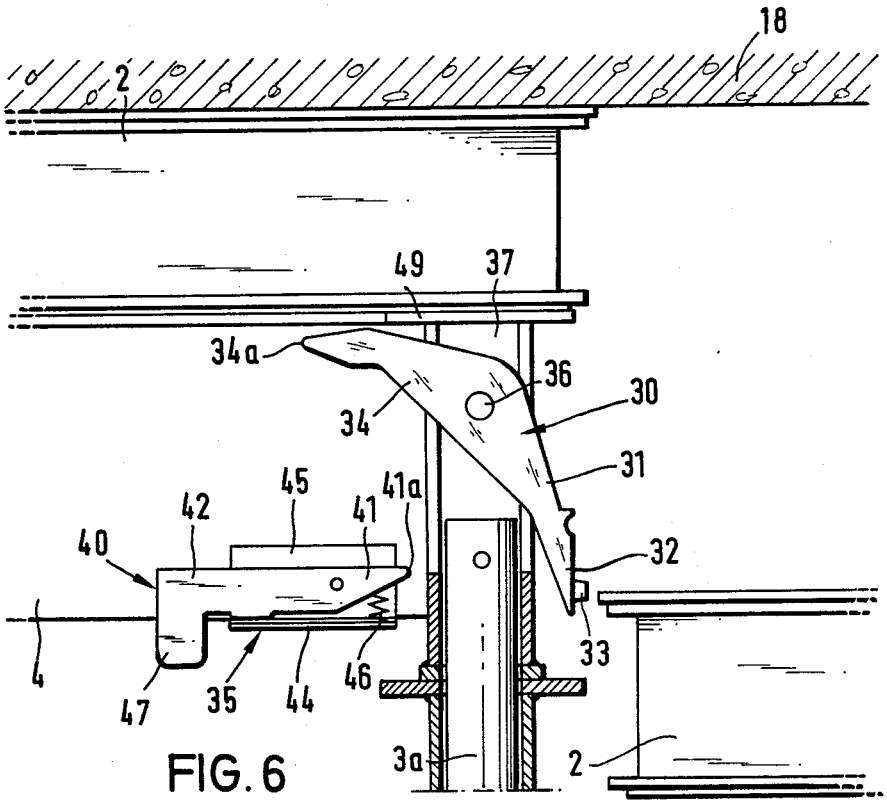
FIG. 6 illustrates a view as in FIGS. 2 and 3, in which the double-armed lever has been completely swung back out of the operating position and the form board which was originally supported thereby has been removed downwards or it may be installed from below.

Each cross-beam 4 has on its both ends bushes 37 of this type into which a tube-like adapter **3*a* can be inserted. Said adapters are to be inserted into the upper ends of the shores 3 and are to be secured by a pin 38, as may be seen from FIGS. 5 and 6**.

Figure 4:
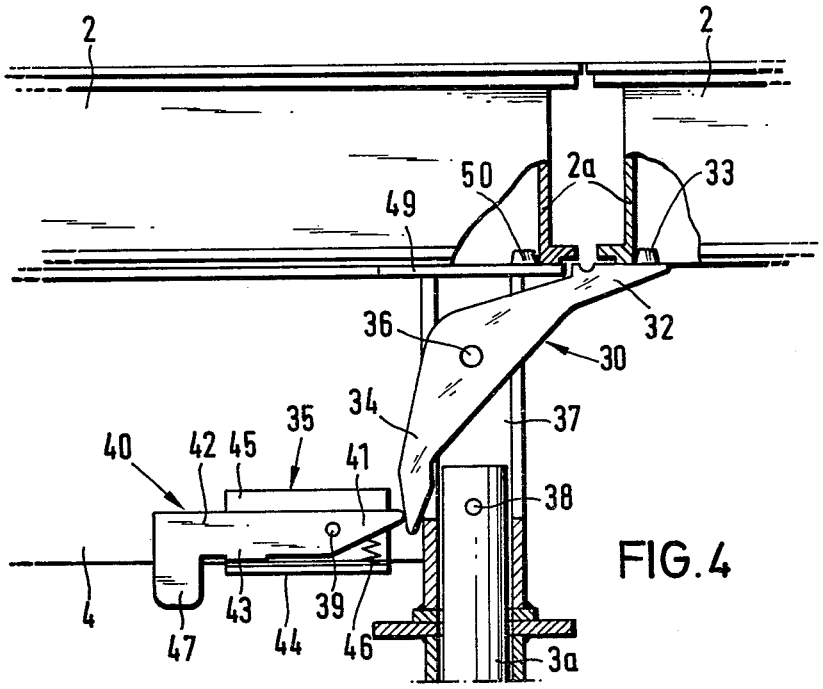
FIG. 4 illustrates a view of the upper end of a shore having a double-armed lever positioned thereon which is checked by a catch in the operating position.

Each catch 35 has a double-armed bolt 40 which may be pivoted about a horizontal shaft 39, and the shorter arm 41 of the bolt 40 is designed as a nose **41*a* co-operating with the lever arm 34 of lever 30. The longer and heavier arm 42 is provided on its lower side with a projecting ridge 43 which co-operates as an end stop with the horizontal flange 44 of a seat 45 of the safety catch 35 which is L- or U-shaped in front view. The bolt 40 is pressed by the weight of the longer arm 42 into the position which may be seen in FIGS. 4 and 6 in which the ridge 43 rests on the flange 44. A compression spring 46 positioned between the flange 44 and the shorter arm 41 promotes the return motion of the bolt 40**, even in case it is soiled or the like.

Figure 5:
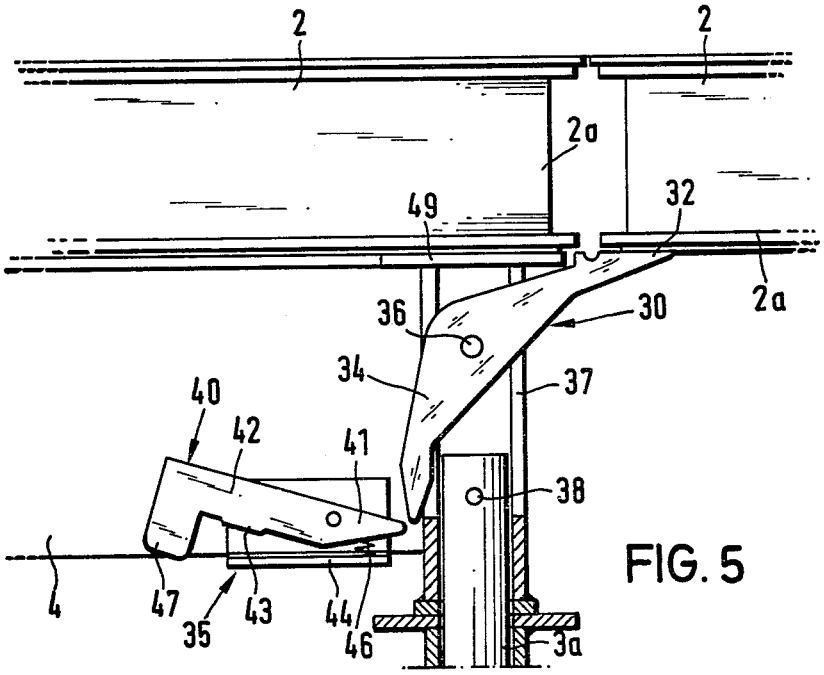
FIG. 5 illustrates a view as in FIG. 4, in which the catch is released from the lever so that the lever may be swung back out of the operating position.

In order to release the bolt 40 from the lever 30, the bolt may be pivoted into the position illustrated in FIG. 5. A downwardly projecting extension 47 is provided at the outer end of the bolt 40 and projects over the lower edge of the cross-beam 4 and is used for attaching a release tool, such as, for example, a simple rod 48 which is used by a person standing on the floor 49, as illustrated in FIG. 7.

However, the rod 48 may be used not only for releasing the catch 35 but also for pivoting the individual levers 30 into their operating position, as illustrated in FIG. 8. In this case, the rod 48 is attached onto the lever arm 31 provided with the support 32 in order to swing the arm 31 upwards. As soon as the lever arm 34 comes into contact with the top of the bolt 40, it forces the arm 41 down against the force of the compression spring 46 until the rounded-off outer end 34*a* has passed over the rounded-off nose 41*a* of arm 41. Bolt 40 then falls back again into its normal position in which it is also secured by the compression spring 46, so that lever 30 is held in its operating position, which may be seen in FIG. 4. Thus, when swinging upwards, lever 30 is allowed to snap into its end position from which it may only be released again when bolt 40 is intentionally lifted into the position illustrated in FIG. 5.

Cross-beam 4 is provided at its both ends with a horizontal flat support 49 having two upwardly projecting noses 50 in form of truncated pyramids, for supporting and adjusting the corners of form boards 2 so that after assemblance they contact one another thus that their surfaces form a continuous upper surface, as can be seen in the drawings. At each end of the cross-beam 4 two noses 50 are provided in tandem on each flat support, as well as each lever 30 is provided with two noses 33 in the same manner. Accordingly, there are four noses 33 and 50, respectively, in each area where four boards 2 contact one another with their corners so that into the corner of the frame 2*a* of each board 2 a nose projects to adjust the position of this corner and to avoid that the board can slide on its support 32 or 49.

It may be seen that the levers 30 catching in behind the resiliently flexible catch 35 in their pivoted-out operating position may be remotely controlled by a rod 48 or by a similar tool, so that for constructing the ceiling formwork 1 as well as for dismantling the same, nobody has to directly reach up to these levers. The levers 30 fall down into the position illustrated in FIG. 6 due to higher weight of lever arm 31 when bolt 40 is released so that they do not obstruct either the erection or the removal of the form boards 2. Thus, the operation of dismantling the form may be accelerated.

The form system which has been described and is illustrated in the drawings comprises three basic elements, namely the shores to be positioned perpendicularly, the cross-beams which interconnect pairs of shores, and the form boards to be mounted horizontally thereon. Crossgirders for supporting the boards in the form position are not required. Ceiling formworks of any surface area and/or of any overall height may be erected or dismantled from below using these three basic elements, involving a minimum number of workmen. The form may be dismantled such that initially only some of the boards, namely the boards mounted on the pivoted-out levers 30 (intermediate panels) are dismantled, while the remaining boards (basic panels) are dismantled only after the concrete ceiling 18 has acquired an adequate strength. The boards 2 having a frame 2*a* which is open at the bottom grip with their frame over the noses 33 and 50, respectively, in such a manner that they can be pivoted around two of said noses, which thus from a hinge. Therefore, the form boards 2 can for instance be hanged up on cross-beams 4 as shown in FIG. 1.

We claim:

1. A form system wherein the said catch is in the form of a locking latch which is adjustable against a force applied by a weight or a spring.

2. A form system according to claim 1, wherein said catch is a double-armed bolt which is mounted for pivotal movement about a horizontal axis, the arm of said bolt which co-operates with said lever being shorter and lighter than the other arm.

3. A form system according to claim 2, wherein the shorter arm of said bolt has a rounded-off nose which co-operates with the double-armed lever and said longer arm of the bolt is provided with a downwardly projecting extension for receiving a release tool.

4. A form system according to claim 2, wherein a compression spring is arranged to urge the shorter arm of said bolt into its closed position and bears generally perpendicularly against the shorter arm of said bolt.

5. A form system for ceiling formworks, said form system comprising vertically extensible shores, said shores being arranged in pairs and each pair having upper ends connected by a head piece, said pairs of shores being longitudinally spaced for having directly supported on head pieces thereof form boards, said pairs of shores being transversely spaced for mounting between form boards carried thereby intermediate form boards with edges of said form boards being adjacent one another and said form boards defining a continuous planar forming surface, and each head piece having at at least one end thereof a laterally extensible support for engaging and directly supporting an intermediate form board at a corner thereof.

6. A form system according to claim 5 wherein each form board includes a frame open at an underside thereof, and each support has an upstanding projection for interlocking engagement with a respective intermediate form board with a respective one of said extensible supports forming a hinge therefor.

7. A form system as claimed in claim 5, wherein each head piece is a cross-beam which interconnects a pair of shores.

8. A form system according to claim 5, wherein each support is a double-armed lever mounted for pivotal movement about a horizontal axis, one arm of said lever has a flat supporting surface for the frame of a form board while the other arm cooperates with an adjustable catch, said supporting surface being provided with two truncated pyramid projections arranged in tandem.

9. A form system according to claim 8, wherein that arm of said lever having said flat supporting surface is heavier than the other arm of said lever whereby said lever normally assumes a downwardly sloping position with said lever arm having said supporting surface thereon being lowermost.

* * * * *

UNITED STATES PATENT AND TRADEMARK OFFICE

CERTIFICATE OF CORRECTION

PATENT NO. : 4,467,993

DATED : August 28, 1984

INVENTOR(S) : Wolfgang Markewitz and Heinz Schwechheimer

It is certified that error appears in the above-identified patent and that said Letters Patent is hereby corrected as shown below: CLAIMS 1 and 3 should read:

1. A form system according to claim 8 wherein the said catch is in the form of a locking latch which is adjustable against a force applied by a weight or a spring.

3. A form system according to claim 2, wherein the shorter arm of said bolt has a rounded-off nose which co-operates with the double-armed lever and said longer arm of [the] said bolt is provided with a downwardly projecting extension for receiving a release tool.

Signed and Sealed this

Ninth Day of April 1985

[SEAL]

*Attest:*

DONALD J. QUIGG

*Attesting Officer* *Acting Commissioner of Patents and Trademarks*